US009232324B2

(12) United States Patent
Nielsen

(10) Patent No.: US 9,232,324 B2
(45) Date of Patent: Jan. 5, 2016

(54) HEARING INSTRUMENT WITH A WALL FORMED BY A PRINTED CIRCUIT BOARD

(75) Inventor: Henrik Nielsen, Roskilde (DK)

(73) Assignee: GN RESOUND A/S, Ballerup (DK)

( * ) Notice: Subject to any disclaimer, the term of this patent is extended or adjusted under 35 U.S.C. 154(b) by 650 days.

(21) Appl. No.: 12/810,816

(22) PCT Filed: Dec. 22, 2008

(86) PCT No.: PCT/DK2008/000449

§ 371 (c)(1),
(2), (4) Date: Sep. 28, 2010

(87) PCT Pub. No.: WO2009/083007

PCT Pub. Date: Jul. 9, 2009

(65) Prior Publication Data

US 2011/0280423 A1 Nov. 17, 2011

Related U.S. Application Data

(60) Provisional application No. 61/017,087, filed on Dec. 27, 2007.

(30) Foreign Application Priority Data

Dec. 27, 2007 (DK) ..... 2007 01880

(51) Int. Cl.
*H04R 25/00* (2006.01)

(52) U.S. Cl.
CPC ..... *H04R 25/608* (2013.01); *H04R 25/656* (2013.01); *H04R 25/405* (2013.01);

(Continued)

(58) Field of Classification Search
USPC ..... 381/328
See application file for complete search history.

(56) References Cited

U.S. PATENT DOCUMENTS 3,783,201 A 1/1974 Weiss et al.
4,553,627 A 11/1985 Gastmeier (Continued)

FOREIGN PATENT DOCUMENTS

DE 29718503 10/1997
DE 102005045896 4/2007

(Continued)

OTHER PUBLICATIONS

Pawel J. Jastreboff: "Tinnitus Habituation Therapy (THT) and Tinnitus Retraining Therapy (TRT)". Tinnitus Handbook, pp. 357-376.

(Continued)

*Primary Examiner* — Davetta W Goins
*Assistant Examiner* — Amir Etesam
(74) *Attorney, Agent, or Firm* — Vista IP Law Group, LLP

(57) ABSTRACT

A hearing instrument includes a housing, a printed circuit board, a signal processor on the printed circuit board, wherein the signal processor is configured for generating an audio signal, and a receiver that is connected to an output of the signal processor for converting the audio signal into a sound signal, wherein the housing is configured to accommodate the receiver and the printed circuit board with the signal processor, and the housing has a trunk part that is coupled with a tip part, and wherein the printed circuit board forms a wall within the housing extending transversely relative to a longitudinal extension of the trunk part.

31 Claims, 14 Drawing Sheets

Figure 1:
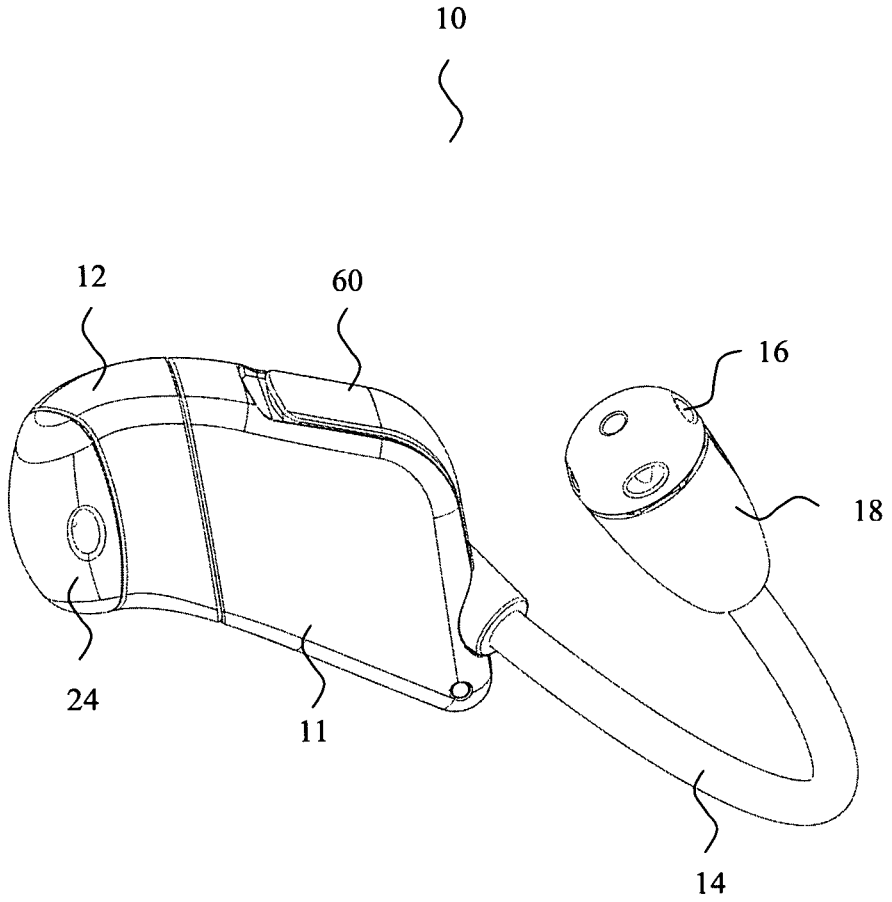

(52) U.S. Cl.
CPC ..... *H04R25/453* (2013.01); *H04R 25/456* (2013.01); *H04R 25/602* (2013.01); *H04R 25/604* (2013.01); *H04R 25/652* (2013.01); *H04R 25/654* (2013.01); *H04R 25/75* (2013.01); *H04R 2225/021* (2013.01); *H04R 2225/63* (2013.01); *H04R 2460/09* (2013.01); *H04R 2460/11* (2013.01)

(56) References Cited

U.S. PATENT DOCUMENTS

| | | | | |
|---|---|---|---|---|
| 4,672,672 | A | 6/1987 | Eggert et al. | |
| 5,048,090 | A | 9/1991 | Geers | |
| 5,265,168 | A * | 11/1993 | Schiess et al. | 381/324 |
| 5,403,262 | A | 4/1995 | Gooch | |
| 5,619,580 | A | 4/1997 | Hansen | |
| 5,654,530 | A | 8/1997 | Sauer | |
| 5,680,467 | A | 10/1997 | Hansen | |
| 6,498,858 | B2 | 12/2002 | Kates | |
| 6,876,749 | B1 * | 4/2005 | Killion et al. | 381/122 |
| 7,856,111 | B2 * | 12/2010 | Balke | H04R 25/652 381/322 |
| 2001/0040973 | A1 * | 11/2001 | Fritz et al. | 381/322 |
| 2001/0051776 | A1 | 12/2001 | Lenhardt | |
| 2004/0047483 | A1 | 3/2004 | Bauman | |
| 2004/0131200 | A1 | 7/2004 | Davis | |
| 2006/0159298 | A1 | 7/2006 | von Dombrowski et al. | |
| 2006/0185969 | A1 | 8/2006 | Erbe | |
| 2007/0195981 | A1 | 8/2007 | Le | |

FOREIGN PATENT DOCUMENTS

| | | | |
|---|---|---|---|
| EP | 1816894 | | 8/2007 |
| GB | 2134689 | | 8/1984 |
| GB | 2305067 | | 3/1997 |
| JP | H 1066196 | A | 3/1998 |
| JP | 2003-505996 | A | 2/2003 |
| WO | 9700593 | | 1/1997 |
| WO | 99/04601 | A1 | 1/1999 |
| WO | 01/08444 | A2 | 2/2001 |
| WO | 0108443 | | 2/2001 |
| WO | 0149070 | | 7/2001 |
| WO | 0203757 | | 1/2002 |
| WO | 02052890 | A | 7/2002 |
| WO | 03030772 | | 4/2003 |
| WO | 2004010734 | | 1/2004 |
| WO | 2006/026988 | A1 | 3/2006 |
| WO | 2006/056198 | A2 | 6/2006 |
| WO | 2007014950 | | 2/2007 |

OTHER PUBLICATIONS

International Type Search Report dated Jun. 16, 2008 for DK Application No. PA 2007 01880.
Danish Office Action dated Jul. 14, 2008 for DK Application No. PA 2007 01880.
Novelty Search Report dated Nov. 16, 2007 from Swedish Patent and Registration Office.
Luca Del Bo et al.: "Using Open-Ear Hearing Aids in Tinnitus Therapy". BTE and Open Hearing Aid Fittings: Hearing Research. Aug. 2006.
International Search Report and Written Opinion dated Jul. 28, 2009 for International Application No. PCT/DK2008/000449.
Luca Del Bo et al, "Using Open-Ear Hearing Aids in Tinnitus Theraphy", Hearing Review, Aug. 2006, 7 pages.
Notification of Reasons for Rejection dated Dec. 18, 2012 for Japanese Patent Application No. 2010-540028 with English Translation, 5 pages.
European Office Action dated Oct. 27, 2014 for related EP Patent Application No. 08 869 117.5, 4 pages.
Notification of Reason for Rejection dated Aug. 26, 2014, for related JP Patent Application No. 2010-540028, 4 pages.
Communication pursuant to Article 94(3) EPC dated Aug. 4, 2015, for related European Patent Application No. 08 869 117.5, 4 pages.

* cited by examiner

A

B

HEARING INSTRUMENT WITH A WALL FORMED BY A PRINTED CIRCUIT BOARD

RELATED APPLICATION DATA

This application is the national stage of International Application No. PCT/DK2008/000449, filed on 22 Dec. 2008, which claims priority to and the benefit of U.S. Provisional Patent Application No. 61/017,087, filed on 27 Dec. 2007, and Danish Patent Application No. PA 2007 01880, filed on 27 Dec. 2007, the entire disclosure of all of which is expressly incorporated by reference herein.

FIELD

The present application relates to a new type of hearing instrument with a housing that is adapted for positioning in the ear canal of a user without obstructing the ear canal of the user. The hearing instrument may be a hearing aid, a tinnitus relieving device, a tinnitus therapy device, a noise suppression device, etc., or any combination of two or more of such devices.

BACKGROUND AND SUMMARY

A conventional in the ear (ITE) or completely-in-the-canal (CIC) hearing aid has a housing that is custom made to individually fit the user's ear canal. The hearing aid components, e.g. electronics, microphone, receiver, battery, etc., are contained in the housing which is closed by a faceplate at the end pointing away from the ear canal. In order to reduce occlusion, a so-called vent, i.e. a ventilation channel, is provided for communication between an opening in the faceplate and the user's ear canal. The vent may be drilled through the housing or shell, or a pipe or tube extending within the hearing aid and connecting an opening in the faceplate with an opening at the opposite end of the housing may constitute the vent. The effectiveness of the vent is increased by increasing the cross-section and decreasing the length of the vent channel.

Behind-the-ear (BTE) hearing aids in which a sound tube conducts sound generated by the receiver of the hearing aid into the ear canal are also well known in the art. In order to position the sound tube securely and comfortably in the ear canal, an earpiece is provided for insertion into the ear canal of the user.

Typically, the ITE or CIC housing or the BTE earpiece is individually custom manufactured to fit precisely in the ear canal of the user without causing pain to the user while still retaining the housing or earpiece securely in place in the ear canal preventing the earpiece from falling out of the ear irrespective of movements of the user, such as chewing or yawning, and also avoiding acoustical feedback generating unpleasant and annoying whistling or howling. The custom made earpiece adds to the cost of the hearing aid and the time needed to fit the hearing aid.

Typically, customized hearing aids are made from solid materials to secure retention and tightness. These hearing aids are placed completely or partially in the ear canal. Since the walls of the ear canal are moving when the jaws move for instance when chewing, the placement of such solid hearing aids in the ear canal can be associated with discomfort for the user.

Several approaches to eliminate this discomfort have been tried, one such approach is to make the canal portion of the device in a soft material, e.g. as disclosed in WO 02/03757 A1. Such devices are complicated to manufacture and will only offer limited venting.

In WO 2004/010734, a canal hearing device is disclosed having a dual acoustic seal system for preventing feedback while minimizing occlusion effects. The two-part device comprises a main module and an elongated tubular insert for conducting sound to the eardrum and sealing within the bony region of the ear canal. The main module is positioned in the cartilaginous portion of the ear canal. The tubular insert comprises a sound conduction tube and a cylindrically hollow primary seal medially positioned in the bony region. The device also comprises a secondary seal laterally positioned in the cartilaginous region.

WO 01/08443 discloses a one-size-fits-all hearing aid, which is adapted to fit into either ear of an ear canal of a user to a depth proximal to the tympanic membrane. The hearing aid is comprised of two half shells joined together to house the hearing aid components. The joined shells secure a flexible tip at the distal end of the shell.

According to a first aspect of some of the embodiments, the above and other objects are fulfilled by a hearing instrument housing for accommodation of a signal processor for generating an audio signal, and a receiver that is connected to an output of the signal processor for converting the processed compensated audio signal into a sound signal, wherein the housing has a trunk part that is interconnected with a tip part, characterized in that the housing further accommodates a printed circuit board with the signal processor, and that the printed circuit board forms a wall within the housing extending transversely to the longitudinal extension of the trunk part.

Preferably, the printed circuit board forms a wall that extends across the entire transversal cross-section of the hearing instrument housing and seals the inner volume on one side of the wall from the inner volume residing on the other side of the wall, and preferably seals the inner volume of the tip part from at least a part of the inner volume of the trunk part, preferably the entire inner volume of the trunk part. However, the printed circuit board may have an area that is less than the area of the transversal cross-section of the housing, such as larger than 50%, preferably larger than 60%, more preferred larger than 70%, even more preferred larger than 80%, still more preferred larger than 90%, most preferred larger than 95% of the area of the transversal cross-section of the housing.

In the following, the printed circuit board with the signal processor is termed the "Signal Processor Module".

By accommodation of the Signal Processor Module as a wall in the hearing instrument housing, a minimum of space is required by the Signal Processor Module in the housing whereby the size of the housing is minimized. As a wall, the Signal Processor Module extends in a direction transversal to, preferably substantially perpendicular to, the longitudinal extension of the housing so that the housing can be made shorter than a conventional housing so that the housing may be positioned deeper in the ear canal of the user making it more invisible to another person.

The Signal Processor Module wall also eliminates the a need of a wall in the housing made as an integral part of the housing thereby saving material for the housing and leading to a further shortened housing. The wall further constitutes a supporting element of the housing that may lead to further material savings of the housing.

The minimum space requirement resulting from utilising the Signal Processor Module as a transversal wall in the hearing instrument facilitates provision of an open solution.

In accordance with hearing aid terminology, a hearing instrument with a housing that does not obstruct the ear canal when the housing is positioned in its intended operational position in the ear canal; is categorized as "an open solution". The term "open solution" is used, since there will be a passageway between a part of the ear canal wall and a part of the housing so that sound waves may escape from behind the housing between the ear drum and the housing through the passageway to the surroundings of the user. In the following, a housing of a hearing aid providing an open solution is also termed an open solution housing.

A user being fitted with a conventional hearing aid experiences an altered perception of his or her voice mainly due to occlusion of the ear canal by the housing or earpiece. The user typically describes the sound of his or her voice in one of the following terms: "My voice echoes", "My voice sounds hollow" or "I sound like I'm talking in a barrel".

Sounds originating from the vocal tract (throat and mouth) are transmitted into the ear canal through the cartilaginous tissue between these cavities and the outer portion of the ear canal.

When nothing is positioned in the ear canal, most of this predominantly low frequency sound simply escapes from the ear canal. However, when the ear canal is blocked these bone-conducted sounds cannot escape from the ear canal. The result is a build-up of high sound pressure levels in the residual ear canal volume. This increase in low frequency sound pressure is audible and will cause them to hear their own voice as loud and boomy. Change in perception of own voice is the most dominant occlusion related complaint, but not the only one. Other occlusion related problems include too much amplification at low frequencies for hearing aid users with good low frequency hearing, reduced speech intelligibility, poorer localization, physical discomfort and increased risk of external ear irritation and infection. Hearing aid users do not adapt to occlusion and the occlusion effect has been cited by as many as 27% of hearing aid wearers as a reason for dissatisfaction with their hearing aids. This emphasizes the need for alleviating or, even better, eliminating the occlusion effect.

Provision of an open solution is facilitated by utilisation of the Signal Processor Module with the processor as a wall in the hearing instrument housing. In this way, the occlusion effect is diminished and preferably substantially eliminated.

Further, the open solution housing does not exert pressure on the ear canal wall further improving user comfort.

The open solution housing exerts less influence on the ear canal environment than a conventional housing.

Since the open solution housing occupies only part of a cross-section of an ear canal, the size of the housing need not accurately fit the ear canal of the user and therefore, the housing need not be customized to each user, rather provision of the open solution housing in standard sizes is made possible.

Further, the open solution housing allows passage of natural sounds to the ear drum in the ear canal preserving a sense of direction of sound sources further increasing user comfort and also user safety, for example when manoeuvring in traffic.

For hearing aids with an open solution, passage of natural sounds also relieves the hearing aid from amplifying these natural sound thereby improving sound quality and lowering power consumption, size, and cost of the hearing aid.

The position of the processor on the printed circuit board forming a wall further constitutes a central position simplifying electrical connections with other electrical hearing instrument components.

Further, positioning of the processor on the printed circuit board provides a self-contained Signal Processor Module facilitating handling and testing of the processor and assembly of the processor in the hearing instrument.

Provision of electrical interconnections with the processor on the printed circuit board makes it possible to cast the processor in a protective material, such as a polymer, e.g. a thermosetting epoxide polymer (epoxy), such as an epoxy resin, together with the printed circuit board. Hereby, the processor is embedded in the material that provides protection against the environment of the processor and also against handling and possible impacts. In this way, the Signal Processor Module constitutes a robust self-contained unit further facilitating handling and testing of the processor and assembly of the processor in the hearing instrument.

Further, the printed circuit board may have electrical connectors mechanically formed to mate with electrical components not residing on the printed circuit board, for example one or more microphones, the receiver, the battery, etc. In this way, wiring in the hearing instrument is saved whereby easy assembly of the hearing instrument is facilitated leading to lowered manufacturing cost.

In an embodiment with a microphone, the receiver and the microphone are preferably positioned on opposite sides of the Signal Processor Module whereby the Signal Processor Module will act as a sound barrier suppressing internal feedback caused by acoustic signals transmitted from the receiver to the microphone within the hearing instrument housing. Internal feedback is further explained below.

Further, when the Signal Processor Module comprises a connector for making mechanical and electrical contact with the receiver, the receiver may be installed in the hearing instrument housing by the dispenser so that the dispenser may be able to offer a variety of models to the user without a need for purchasing and storing a similar variety of hearing instruments. The receiver may be interconnected with the mating connector in any conventional way, e.g. by removable insertion into the mating connector, by soldering, etc.

The hearing instrument may further comprise a battery or batteries for power supply of the electric components of the hearing instrument. The battery or batteries may be rechargeable or non-rechargeable.

The Signal Processor Module may further comprise connector pads for connection with the battery for power supply of the hearing instrument circuitry.

The hearing instrument may further comprise first springs interconnected with the connector pads for interconnection of the Signal Processor Module with the battery.

The first springs may further be configured for provision of a mechanical snap fit coupling of the Signal Processor Module to the hearing instrument housing.

The hearing instrument may further comprise second springs interconnected with signal lines in an elongate member that is attached to the housing and wherein the elongate member is adapted for positioning in the pinna and outside the ear canal of the user for retention of the housing in the ear canal.

The second springs may be configured for provision of a mechanical snap fit coupling of the Signal Processor Module to the hearing instrument housing.

The positions of the first and second springs to which the Signal Processor Module is coupled in its operational position in the hearing instrument housing, are stabilized by the Signal Processor Module in its operational position in the hearing instrument housing.

The Signal Processor Module may further comprise connector pads, such as solder pads, for connection with programming equipment for the hearing instrument. During programming of the hearing instrument, e.g. adjustment of signal processing parameters of the hearing instrument, a programming connector of the programming equipment for the hearing instrument is inserted in the hearing instrument housing, e.g. the battery compartment of the housing, for electrical interconnection with the connector pads. The programming connector may mechanically engage with at least one or more of the first and second springs in the housing for keeping the programming connector in a fixed position during programming. Alternatively or additionally, in one embodiment, the battery door may be closed for retaining the programming connector in the battery compartment.

In this way, the interconnecting part of the programming equipment is simplified electrically and mechanically since connecting elements already present in the hearing instrument can also be used for interconnection with the programming equipment.

Preferably, the housing is attached to an elongate member configured for positioning in the pinna and outside the ear canal of the user for retention of the housing in the ear canal.

Retention of the hearing instrument in the proper place is important. Jaw movements can exert outward forces on parts of the hearing instrument housing that reside in the ear canal during use. Preferably, the elongate member has sufficient resilience to counteract this force thereby securing parts of the hearing instrument housing residing in the ear canal from outward motion.

The elongate member may be adapted to be positioned in the pinna of the user around the circumference of the conchae abutting the antihelix and at least partly covered by the antihelix for retainment of its position.

The elongate member may be preformed during manufacture, preferably into an arched shape with a curvature slightly larger than the curvature of the antihelix, for easy fitting of the elongate member into its intended position in the pinna.

The elongate member may be resilient for assisting in retaining the trunk part of the housing in the ear canal of the user so that the trunk part of the housing remains securely in place in the ear canal without falling out of the ear irrespective of movements of the user, such as smiling, chewing or yawning. Retention is provided without causing pain to the user.

Preferably, the elongate member is resilient in a direction perpendicular to its longitudinal extension thereby providing further capability of retention of the trunk part of the housing in the ear canal of the user. During positioning of the housing in its intended position in the ear canal of the user, the transverse resilience of the elongate member facilitates insertion of the housing into the ear canal of the user.

The elongate member may further be adapted to abut part of the concha at the antitragus when the housing has been inserted in the ear canal thereby applying a force to the housing towards an upper part of the ear canal and thereby retaining the housing in a position in which the housing is pressed against the wall of the upper part of the ear canal. The upper part of the ear canal remains relatively unaffected during jaw movement so that parts of the housing resting against the upper part of the ear canal wall are subjected to the least possible outward moving forces during jaw movement.

Preferably, the elongate member is adapted to abut the antihelix and extend at least to the inferior crus of the antihelix when the housing is positioned in the ear canal of the user.

More preferred the elongate member is adapted for positioning of the second end at the cimba concha below the triangular fossa of the ear of the user when the trunk part of the housing is positioned in the ear canal of the user.

The elongate member may be adapted for accommodation of a microphone. For example, the elongate member may be adapted for accommodation of the microphone at its second end. The elongate member may have a larger cross-section at its second end accommodating the microphone than a remaining part of the elongate member extending therefrom and towards the first end.

Positioning of the microphone of a hearing aid at the second end of the elongate member provides a large distance between the microphone and the hearing aid receiver thereby minimizing feedback.

Feedback limits the maximum gain available to the user of the hearing aid. Feedback refers to the amplified signal returning to a hearing aid input. The feedback path may be an acoustic feedback path of sound propagating from the receiver along a path outside the hearing instrument to the microphone. This phenomenon, which is also known as acoustical feedback, occurs e.g. when a hearing instrument housing does not completely fit the wearer's ear, or in the case of a housing comprising a so-called vent, i.e. a canal or opening for e.g. ventilation purposes. In both examples, sound may "leak" from the receiver to the microphone and thereby cause feedback.

Additionally, inductive feedback may occur in the hearing aid, for example via a telecoil of the hearing aid coupling a magnetic field generated by the receiver into the telecoil thereby generating a hearing aid input signal.

Oscillation may arise when the attenuation provided by the feedback path is smaller than the hearing aid gain. A large distance between the microphone and the receiver alleviates this problem.

The external feedback signal path is typically an acoustic path between the microphone and the receiver, i.e. an external feedback signal propagates through air surrounding the hearing instrument.

However, feedback in a hearing instrument may also occur internally since sound can be transmitted from the receiver to the microphone along a path inside the hearing instrument housing.

The internal feedback signal path between the microphone and the receiver may comprise a mechanical signal path, an acoustical signal path, or a combination of mechanical and acoustical signal paths.

Here, the term acoustical refers to sound propagating as pressure waves in a gas, such as ordinary air within the hearing aid, while the term mechanical refers to sound propagating as vibrations through solid materials, such as the hearing instrument housing, receiver/microphone mountings etc.

Thus, the internal feedback signal path may comprise mechanical elements in the hearing aid, such as receiver, microphone, mountings and housing, and in some cases, also an acoustical element, such as air within the hearing instrument housing.

Typically, the main source of mechanical feedback is the receiver generating vibrations transmitted to other parts of the hearing instrument, e.g. via the receiver mounting(s). For this reason, in some state-of-the-art hearing aids of the ITE-type (In-The-Ear), the receiver is not fixed, rather it is flexibly mounted within the hearing aid housing whereby transmission of vibrations from the receiver to other parts of the device is reduced.

While the problem of external feedback limits the maximum gain available in a hearing aid during use, the problem of internal feedback has its main influence in the production process of hearing instruments with a microphone, where it is today a very time-consuming manual procedure to mount and/or place receiver and microphone(s) in the devices in such a way that internal feedback is minimised.

The continuing minimisation of the size of a hearing aid makes it more and more critical to accurately position the receiver in the hearing aid housing during manufacture or service so that internal feedback is kept at a minimum. This also makes the hearing instrument less robust against bumps or impacts against the surroundings that may occur during use of the hearing instrument, since a slight displacement of the receiver may cause sufficient internal feedback to significantly reduce the maximum gain made available to the user without howling or whistling of the hearing instrument.

Thus, suppression of internal feedback makes positioning of the receiver easy to perform during manufacture or service and robust during use without reducing the maximum gain made available to the user of the hearing instrument.

Further, suppression of internal feedback makes it possible to mount the receiver in close contact with the hearing instrument housing, since the internal mechanical and/or acoustical feedback will be suppressed due to the long distance between receiver and microphone. Thus, the previously required suspension of the receiver in resilient suspensions within the hearing instrument is no longer necessary. The receiver may be snugly fitted within the hearing instrument housing, e.g. within a compartment of the hearing instrument housing having mechanical support elements abutting the hearing instrument when mounted and keeping the receiver in a specific position during use. The mounting of the receiver is thereby made robust against mechanical bumps or impacts that the hearing instrument will experience during transport or use. Further, the manufacture of the hearing instrument is simplified and less costly and makes it easy to calibrate.

Further, absence of specific receiver mountings makes more volume available inside the hearing instrument housing for a larger receiver so that the present hearing instrument housing is capable of accommodating a larger receiver than can be accommodated inside similar sized conventional hearing instrument housings. Thus, the present hearing instrument housing with a microphone in the elongate member is capable of providing a larger gain than provided by similar sized conventional hearing instrument housings.

Provision of a long distance between the receiver and the microphone suppresses internal feedback.

Provision of the PCB wall further suppresses internal feedback.

As further described below, electronic feedback suppression may also be provided in the hearing instrument according to some embodiments.

The elongate member may accommodate further electrical hearing instrument components.

In an elongate member with a microphone at the second end of the elongate member, the elongate member is preferably substantially rigid in the direction of its longitudinal extension so that electrical conductors residing in the elongate member are protected against breaking.

With a microphone in the elongate member at its second end, localisation is substantially maintained when the microphone is positioned at a location within the pinna wherein the microphone receives a sound signal that allows the user to perceive the direction towards a sound source. Then, the sound signal based on which the user is capable of perceiving direction is transmitted to the ear drum of the user by the hearing aid. For example, sense of direction may be substantially maintained when the microphone is positioned at the cimba concha below the triangular fossa in the pinna.

Two microphones may be accommodated at the second end of the elongate member for provision of noise suppression and/or further directionality.

The elongate member and the trunk part preferably form separate units that are manufactured in separate pieces. The trunk part of the housing and the elongate member may be interconnected mechanically and possibly electrically via the left ear connector or the right ear connector during manufacture of the hearing instrument, or they may be interconnected at a later stage, e.g. by the dispenser during fitting of the hearing instrument to a user.

The elongate member according to some embodiments is preferably manufactured in a number of standard sizes to fit the human anatomy of the pinna of most users. In this way, the manufacturing cost is lowered as compared to the manufacturing cost of customized elongate members.

The present hearing instrument housing is preferably manufactured in a number of standard sizes to fit the human anatomy of the ear canal of most users. In this way, the manufacturing cost is lowered as compared to the manufacturing cost of customized housings. Various standard sizes may also be provided for accommodation of batteries of different sizes, and various standard sizes may be provided for accommodation of receivers of different sizes.

In a preferred embodiment, the elongate member is removably interconnected with the trunk part of the housing so that a large number of different models of the hearing aid may be provided by combining elongate members of different standard sizes with a standard sized trunk part possibly selected from a set of differently sized trunk parts.

The left ear connector may be configured to be removably attached to the trunk part. Further, the right ear connector may be configured to be removably attached to the trunk part.

The housing may comprise a battery door providing access to a battery compartment for accommodation of a non-rechargeable battery. The elongate member may be attached to the battery door and the battery door may be removably attached to the trunk part of the housing with the right ear connector or the left ear connector included in the battery door for removal of the elongate member from the trunk part together with the battery door.

The battery door with the elongate member may be manufactured in one shape suitable for the right ear and another shape suitable for the left ear. In the shape suitable for the right ear, the elongate member extends from the battery door at a certain angle with relation to the battery door suitable for positioning of the elongate member in the pinna of the right ear when the trunk part has been inserted into the right ear canal of the user. In the shape suitable for the left ear, the elongate member extends from the battery door at a certain angle with relation to the battery door suitable for positioning of the elongate member in the pinna of the left ear when the trunk part has been inserted into the left ear canal of the user.

The connector may further be adapted for making electrical contact with a signal line in the elongate member when the battery door is attached to the housing.

For provision of an open solution, the trunk part and possible further parts of the housing residing in the ear canal during use have a cross-section that is smaller than the cross-section of the ear canal so that occlusion substantially does not occur. When the housing is inserted into the user's ear canal, the smaller cross-section of the trunk part and possible further parts of the housing allows communication between the ear canal between the eardrum and the housing and the surroundings for prevention of occlusion.

The trunk part is preferably substantially straight along its longitudinal extension.

Preferably, the trunk part has a substantially rectangular cross-section perpendicular to its longitudinal extension.

Preferably, the trunk part has a substantially rectangular cross-section extending in parallel with its longitudinal extension.

The trunk part may further comprise a connector configured for making electrical contact with a signal line in the elongate member when the elongate member is attached to the trunk part.

The Signal Processor Module may be included in a set of hearing instrument housing parts that further comprises:

The trunk part shaped for accommodation in the ear canal of a user and configured for interconnection with a left ear connector configured to be attached to the trunk part and to be attached to the first end of the elongate member with the opposite second free end in such a way that the elongate member forms an angle with the longitudinal extension of the trunk part, when operatively interconnected with the trunk part, the angle being suitable for use in the left ear of the user, and a right ear connector configured to be attached to the trunk part and to be attached to the first end of the elongate member with the opposite second free in such a way that the elongate member forms an angle with the longitudinal extension of the trunk part, when operatively interconnected with the trunk part, the angle being suitable for use in the right ear of the user, the elongate member being configured for interconnection with a selected one of the left ear connector and the right ear connector and for positioning outside the ear canal in the pinna for retention of the trunk part in the ear canal.

Provision of such a set of hearing instrument housing parts reduces the number of different mechanical parts needed for being capable of providing hearing instrument housings fitting the right ear and the left ear, respectively, of a large variety of users.

The size and shape of the ear canal vary among individuals. Typically, the ear canal is approximately 26 mm long and 7 mm in diameter. In most cases, the ear canal bends backwards and slightly upward in the medial direction, i.e. in the direction from the entrance of the ear canal towards the ear drum. Thus, a right tip part of the hearing instrument housing fitting into the right ear canal of the user is preferably provided that forms an angle towards the left with relation to the longitudinal extension of the trunk part when seen from above in the medial direction of the ear canal. Further, a left tip part fitting into the left ear canal of the user is preferably provided that forms an angle towards the right with relation to the longitudinal extension of the trunk part when seen from above in the medial direction of the ear canal. Individuals with a straight ear canal requiring a straight tip part are rare.

The set of hearing instrument housing parts may further comprise a right tip part that forms an angle with relation to the longitudinal extension of the trunk part when operatively interconnected with the trunk part, facilitating accommodation in the right ear canal of the user of a hearing instrument housing comprising the interconnected trunk part and right tip part, and a left tip part that forms an angle with relation to the longitudinal extension of the trunk part when operatively interconnected with the trunk part, facilitating accommodation in the left ear canal of the user of a hearing instrument housing comprising the interconnected trunk part and left tip part, the trunk part being further configured for interconnection with a selected one of the left tip part and the right tip part.

The set of hearing instrument housing parts may further comprise a straight tip part that is straight and extends along the longitudinal extension of the trunk part when operatively interconnected with the trunk part.

Tip parts may be manufactured in a number of standard sizes and shapes, e.g. in a number of angles formed with relation to the longitudinal extension of the trunk part when assembled with the trunk part, and in a number of lengths, widths and heights, and in a number of angular depths, i.e. distances from the interconnection between the tip part and the trunk part to the bend of the tip part, etc., for accommodation in respective ear canals of different sizes and with bends occurring at different depths in the ear canal and with different bending angles.

The tip part of the housing may be flexible for variation of the angle for increased wearing comfort.

The tip part may be custom made to individually fit the user's ear canal without causing pain to the user while still retaining the housing securely in place in the ear canal preventing the housing from falling out of the ear irrespective of movements of the user, such as smiling, chewing or yawning.

In one embodiment, a custom made part is provided fitting around a standard sized tip part for individually fitting a standard sized housing to a specific user's ear canal.

In one embodiment, a flexible part fitting around a standard sized tip part is provided for improved fitting of the housing to a specific user's ear canal. The flexible part may be provided in a number of standard sizes.

The hearing instrument may further comprise a cerumen filter that is adapted to be fitted on the receiver or on the tip part of the housing with a snap on coupling.

In a preferred embodiment, the set of hearing instrument housing parts comprises one standard sized trunk part fitting a large majority of possible users, however, the set of hearing instrument housing parts may further comprise a plurality of differently sized trunk parts.

The set of hearing instrument housing parts may further comprise a plurality of differently sized Signal Processor Modules, each of which fits within a hearing instrument housing of a specific size.

The set of hearing instrument housing parts may further comprise a plurality of Signal Processor Modules, each of which carries signal processors adapted for execution of different signal processor programmes, for example different algorithms for compensation of different types of hearing impairment.

The set of hearing instrument housing parts may further comprise a plurality of differently sized receivers.

The set of hearing instrument housing parts may further comprise a plurality of differently sized elongate members.

Thus, typically, a hearing instrument housing for the right ear of a specific user is assembled, e.g. at the point of sale of the hearing instrument, by selection of a specific Signal Processor Module adapted to perform a desired signal processing, and further selection of parts for provision of a best fit with the right ear of the user in question, i.e. the right pinna and the right ear canal of the user and thus, by selection of an appropriately sized trunk part for connection with a selected right ear connector having the elongate member at a desired angle suitable for use in the right ear of the user. Further, the selected trunk part may be interconnected with a selected right tip part that forms a desired angle towards the left in relation to the longitudinal extension of the trunk part when seen from above in the medial direction of the ear canal facilitating accommodation in the right ear canal of the user in question.

A hearing instrument housing for the left ear of a specific user is assembled in a similar way.

Preferably, the receiver is accommodated in the tip part of the housing.

The trunk part of the housing may comprise a connector for making mechanical and electrical contact with the receiver. In this way, the receiver may be installed in the hearing instrument housing at the point of sale, e.g. by the dispenser so that the dispenser may be able to offer a variety of models to the user without a need for purchasing and storing a similar variety of hearing instruments.

Preferably, the trunk part accommodates the signal processor of the hearing instrument for generating an audio signal.

The hearing instrument may further comprise a battery or batteries for power supply of the electric components of the hearing instrument. The battery or batteries may be rechargeable or non-rechargeable.

The size and shape of the housing according to some embodiments has proven to be so comfortable that users are able to sleep well with the housing inserted in an ear canal. This makes the housing well suited for use in tinnitus relieving and noise suppression.

In some embodiments, the hearing instrument constitutes a hearing aid comprising a microphone for converting sound into an audio signal, a signal processor for processing the audio signal for compensating a hearing loss, and a loudspeaker that is connected to an output of the signal processor for converting the processed audio signal into a sound signal. Further, the hearing aid comprises a battery for power supply of the electric components of the hearing aid.

In accordance with hearing aid terminology, the loudspeaker is also denoted a receiver throughout the present specification.

The hearing instrument housing may accommodate the above-mentioned hearing aid components including the microphone in a way similar to the housing of a CIC hearing aid.

In an embodiment, the elongate member accommodates the microphone, e.g. at its second end, and the remaining part or parts of the housing accommodate the other components, and signal conductors extend within the elongate member for electrical interconnection of the microphone with other components in the housing.

In a preferred embodiment, electronic feedback compensation is provided. Feedback is a well-known problem in hearing instruments and several systems for suppression and cancellation of feedback exist within the art. With the development of very small digital signal processing (DSP) units, it has become possible to perform advanced algorithms for feedback suppression in a tiny device, such as a hearing aid, see e.g. U.S. Pat. No. 5,619,580, U.S. Pat. No. 5,680,467 and U.S. Pat. No. 6,498,858.

The above mentioned prior art systems for feedback cancellation in hearing aids deal with external feedback, i.e. transmission of sound between the loudspeaker (often denoted receiver) and the microphone of the hearing aid along a path outside the hearing aid device. This problem, which is also known as acoustical feedback, occurs e.g. when a hearing aid earpiece part does not completely fit the users ear, or in the case of an earpiece part comprising a vent. In both examples, sound may "leak" from the receiver to the microphone and thereby cause feedback.

The problem of external feedback limits the maximum gain available in a hearing aid.

Thus, the hearing instrument may further comprise a feedback compensation circuit for providing a feedback compensation signal of signals picked up by the microphone by modelling an acoustical and mechanical feedback signal path of the hearing instrument, subtracting means for subtracting the feedback compensation signals from the audio signal to form a compensated audio signal, which is input to the signal processor of the hearing instrument.

The feedback signal path is typically an acoustic path between the microphone and the receiver, i.e. an external feedback signal propagates through air surrounding the hearing instrument.

Preferably, the feedback compensation means comprises an adaptive filter, i.e. a filter that changes its impulse response in accordance with changes in the feedback path.

Both static and adaptive filters are well known to a person skilled in the art of hearing instruments, and will therefore not be discussed in further detail here.

Tinnitus is the perception of sound in the human ear in the absence of corresponding external sound(s). Tinnitus is considered a phantom sound, which arises in the auditory system. For example, a ringing, buzzing, whistling, or roaring sound may be perceived as tinnitus. Tinnitus can be continuous or intermittent, and in either case can be very disturbing, and can significantly decrease the quality of life for one who has such an affliction.

Tinnitus is not itself a disease but an unwelcome symptom resulting from a range of underlying causes, including psychological factors such as stress, disease (infections, Menieres Disease, Oto-Sclerosis, etc.), foreign objects or wax in the ear and injury from loud noises. Tinnitus is also a side-effect of some medications, and may also result from an abnormal level of anxiety and depression.

The perceived tinnitus sound may range from a quiet background sound to a signal loud enough to drown out all outside sounds. The term 'tinnitus' usually refers to more severe cases. A 1953 study of 80 tinnitus-free university students placed in a soundproofed room found that 93% reported hearing a buzzing, pulsing or whistling sound. However, it must not be assumed that this condition is normal—cohort studies have demonstrated that damage to hearing from unnatural levels of noise exposure is very widespread.

Tinnitus cannot be surgically corrected and since, to date, there are no approved effective drug treatments, so-called tinnitus maskers have become known. These are small, battery-driven devices which are worn like a hearing aid behind or in the ear and which, by means of artificial sounds which are emitted, for example via a hearing aid speaker into the auditory canal, to thereby psycho acoustically mask the tinnitus and thus reduce the tinnitus perception.

The artificial sounds produced by the maskers are often narrow-band noise. The spectral position and the loudness level of the noise can often be adjusted via for example a programming device to enable adaptation to the individual tinnitus situation as optimally as possible. In addition, so-called retraining methods have been developed, for example tinnitus retraining therapy (Jastreboff P J. Tinnitus habituation therapy (THI) and tinnitus retraining therapy (TRT). In: Tyler R S, ed. Handbook of Tinnitus. San Diego: Singular Publishing; 2000:357-376) in which, by combination of a mental training program and presentation of broad-band sound (noise) near the auditory threshold, the perceptibility of the tinnitus in quiet conditions is likewise supposed to be largely suppressed. These devices are also called "noisers" or "sound enrichment devices". Such devices or methods are for example known from DE 29718 503, GB 2 134 689, US 2001/0051776, US 2004/0131200 and U.S. Pat. No. 5,403,262.

Although present day tinnitus maskers to a certain extent may provide immediate relief of tinnitus, the masking sound produced by them may adversely affect the understanding of speech, partly because S/N (Speech/Noise) ratio would be lower due to the addition of noise, and partly because persons suffering from tinnitus often also suffer from a reduced ability to understand speech in noise as compared to people with normal hearing.

For many people, the known maskers will not provide any long term relief of tinnitus. Recent research conducted by Del Bo, Ambrosetti, Bettinelli, Domenichetti, Fagnani, and Scotti "Using Open-Ear Hearing Aids in Tinnitus Therapy", Hearing Review, August 2006, has indicated that better long term effects for tinnitus relief may be achieved if so-called habituation of tinnitus is induced in a tinnitus sufferer by using sound enrichment by sound from the ambient environment. The rationale behind habituation relies on two fundamental aspects of brain functioning: Habituation of the reaction of the limbic and sympathetic system, and habituation of sound perception allowing a person to ignore the presence of tinnitus. While tinnitus maskers emit sounds that either partly or completely cover the perceived sound of tinnitus, Del Bo, Ambrosetti, Bettinelli, Domenichetti, Fagnani, and Scotti suggest the use of environmental sounds amplified by a hearing aid or by application of artificial sounds, such as band limited noise. According to an aspect of some of the embodiments, the hearing instrument also includes a tinnitus relieving circuit, for example generating sounds useful for relieving tinnitus as described above. The relieving circuit may for example be a tinnitus masker, a sound enrichment circuit, etc.

According to another aspect of some of the embodiments, a tinnitus relieving device or a tinnitus therapy device is provided with a housing and an elongate member as disclosed throughout the present disclosure. The tinnitus relieving device may not have a microphone. In one embodiment, the tinnitus relieving device does not compensate for a hearing loss.

In another embodiment, a hearing instrument includes a tinnitus relieving device or a tinnitus therapy device.

According to yet another aspect of some of the embodiments, a noise suppression device is provided with a housing and an elongate member as disclosed throughout the present disclosure. The noise suppression device may not have a microphone. In one embodiment, the noise suppression device does not compensate for a hearing loss.

In another embodiment, a hearing instrument includes a noise suppression device.

The noise suppression device may have a conventional noise suppression circuit with a signal processor for performing analysis of the waveform of the background aural or non-aural noise, and generation of a polarisation reversed waveform to cancel the background noise out by interference. The generated waveform has identical or directly proportional amplitude to the waveform of the original noise, but its polarity is reversed. This creates the destructive interference that reduces the amplitude of the perceived noise.

In accordance with some embodiments, a hearing instrument includes a housing, a printed circuit board, a signal processor on the printed circuit board, wherein the signal processor is configured for generating an audio signal, and a receiver that is connected to an output of the signal processor for converting the audio signal into a sound signal, wherein the housing is configured to accommodate the receiver and the printed circuit board with the signal processor, and the housing has a trunk part that is coupled with a tip part, and wherein the printed circuit board forms a wall within the housing extending transversely relative to a longitudinal extension of the trunk part.

DESCRIPTION OF THE DRAWING FIGURES

Figure 2:
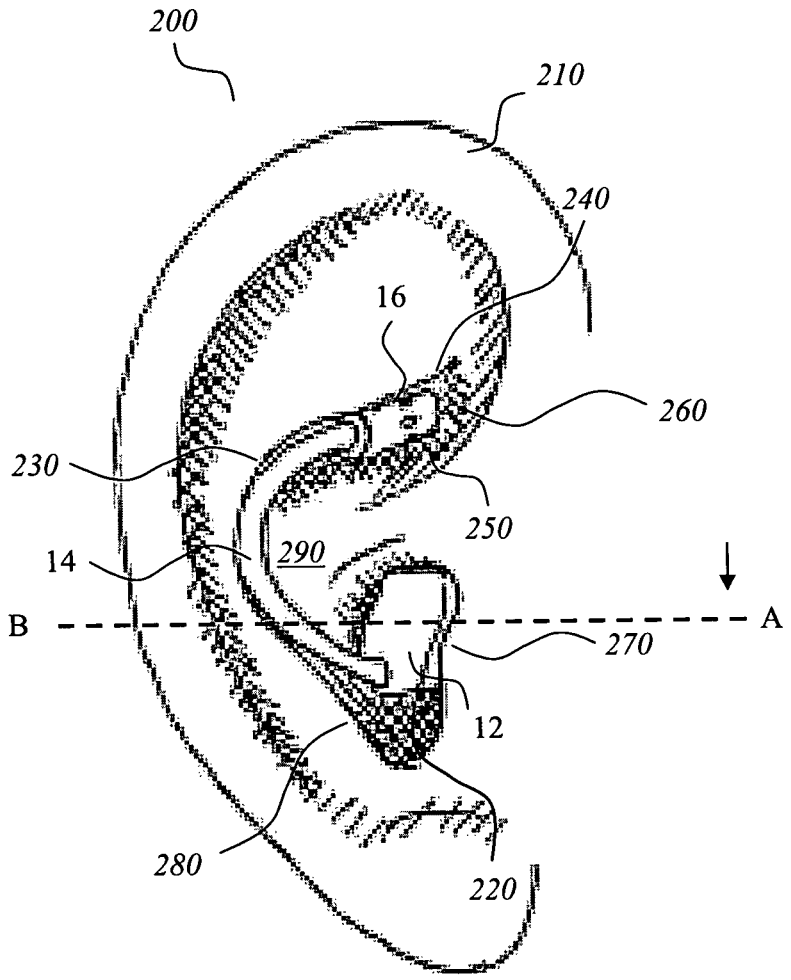
Figure 3:
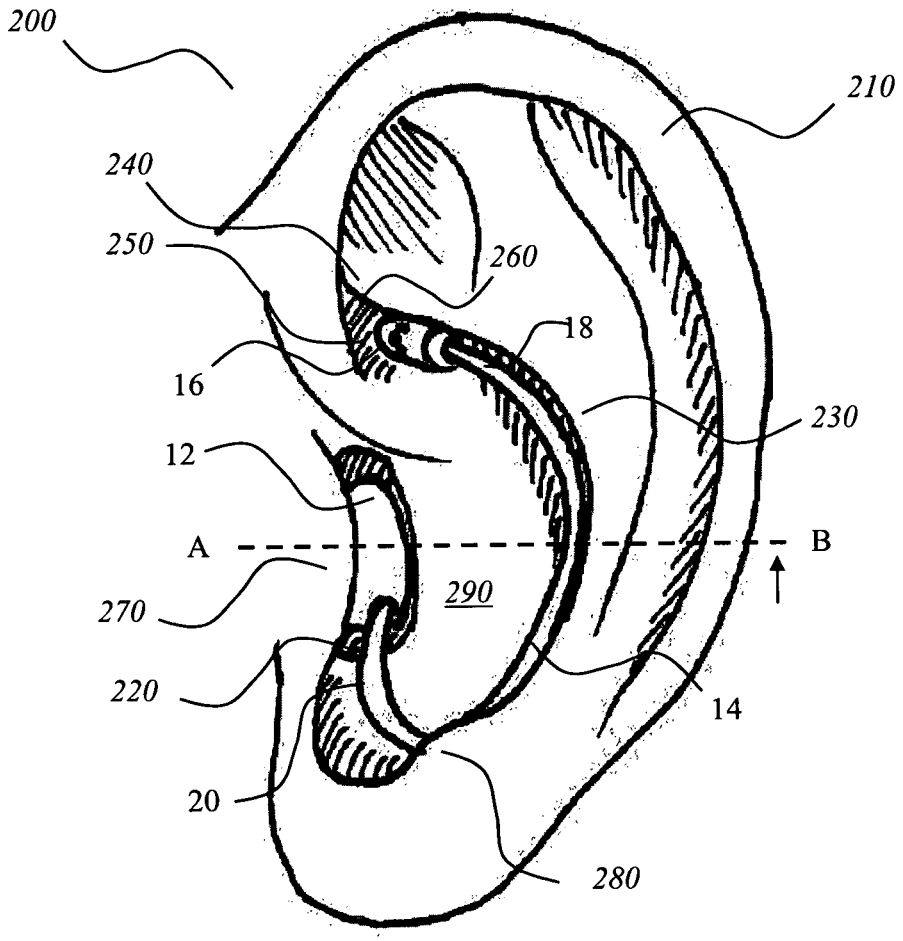
Figure 4:
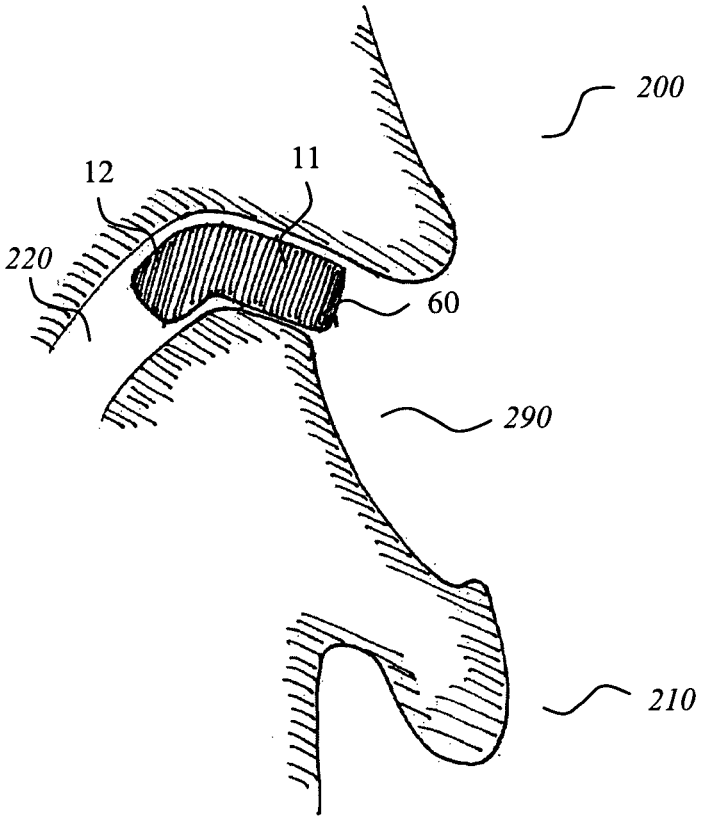
Figure 5:
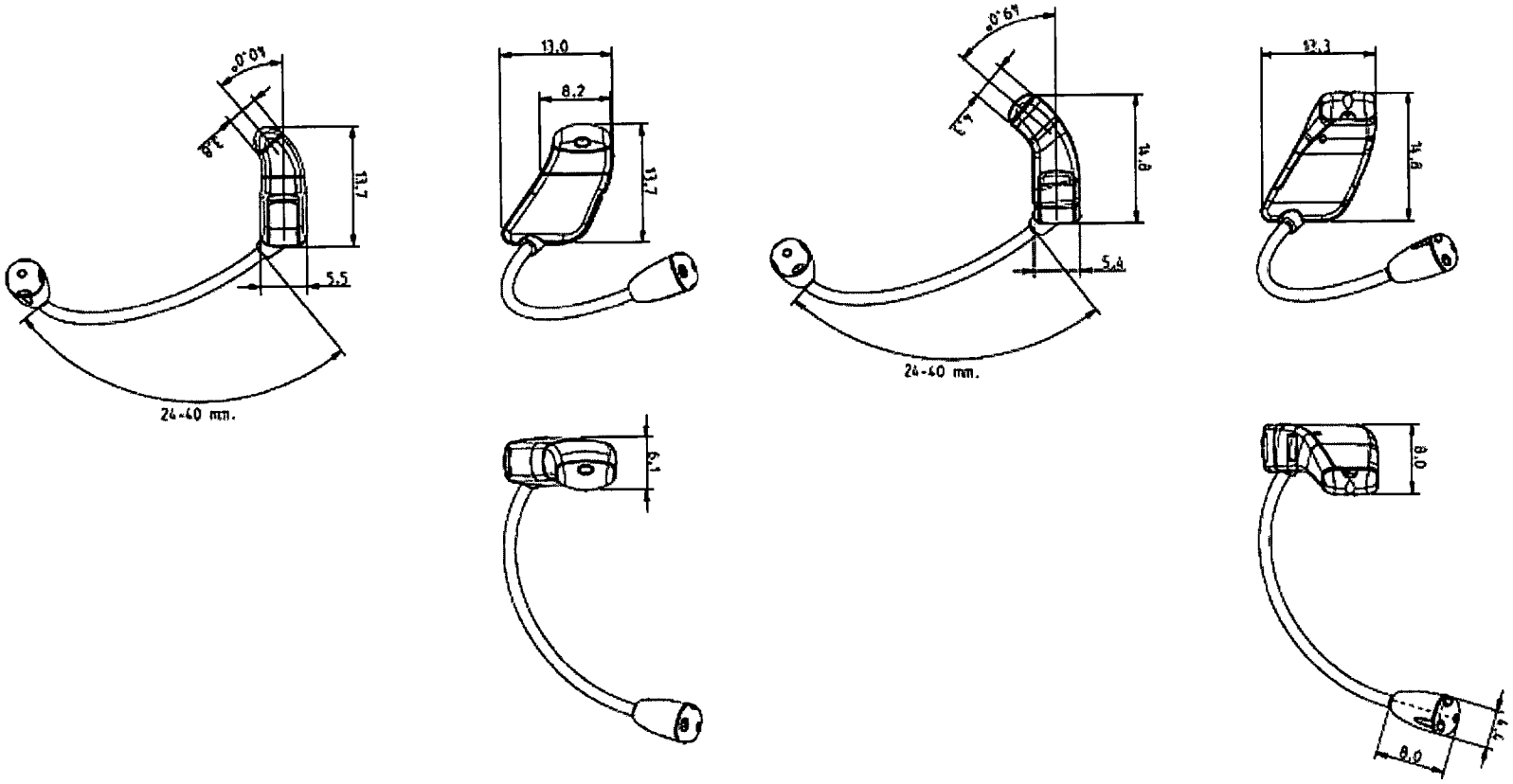
Figure 6:
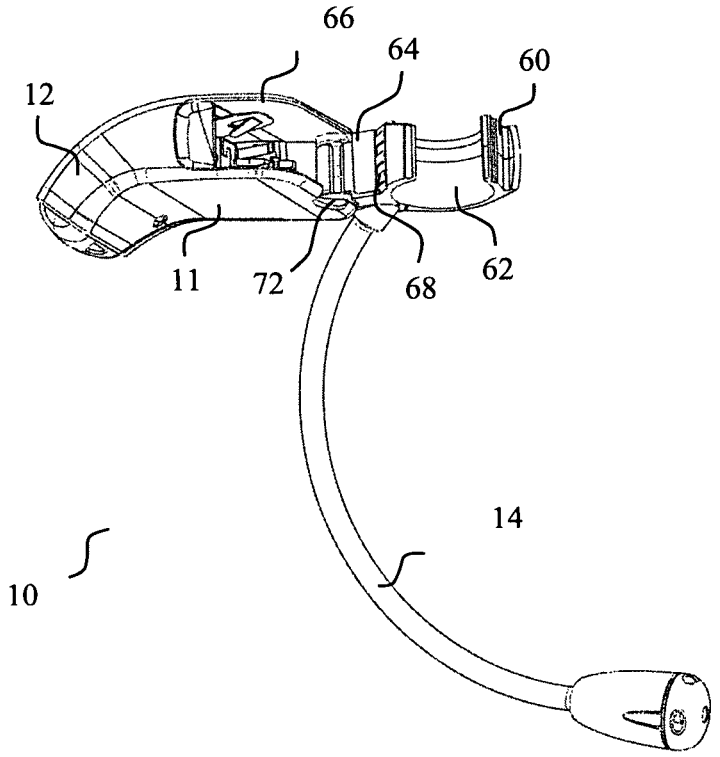
Figure 7:
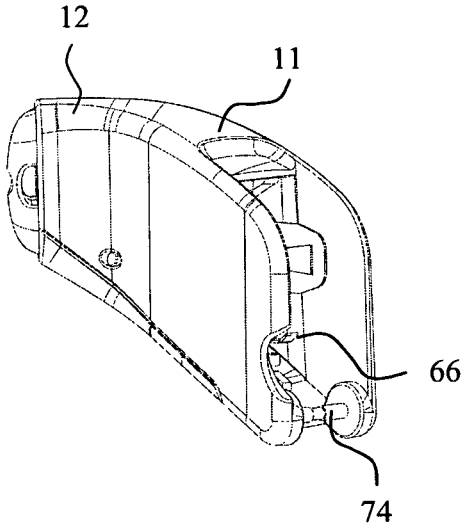
Figure 8:
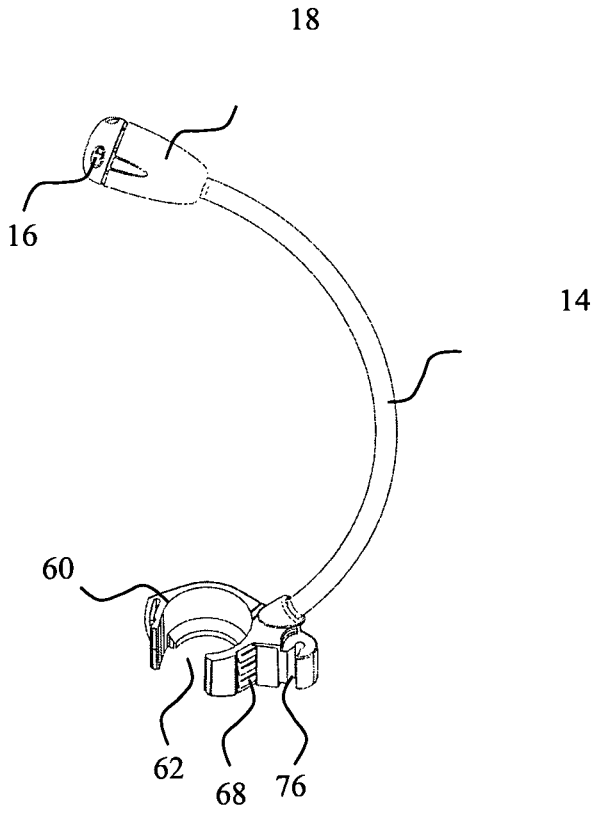
Figure 9:
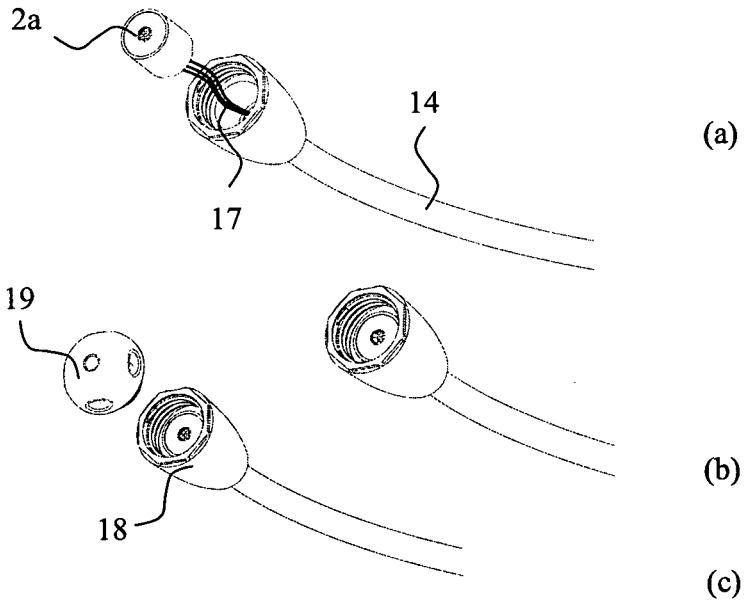
Figure 10:
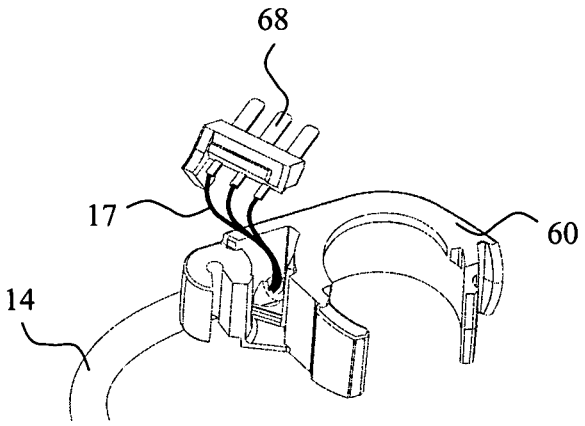
Figure 11:
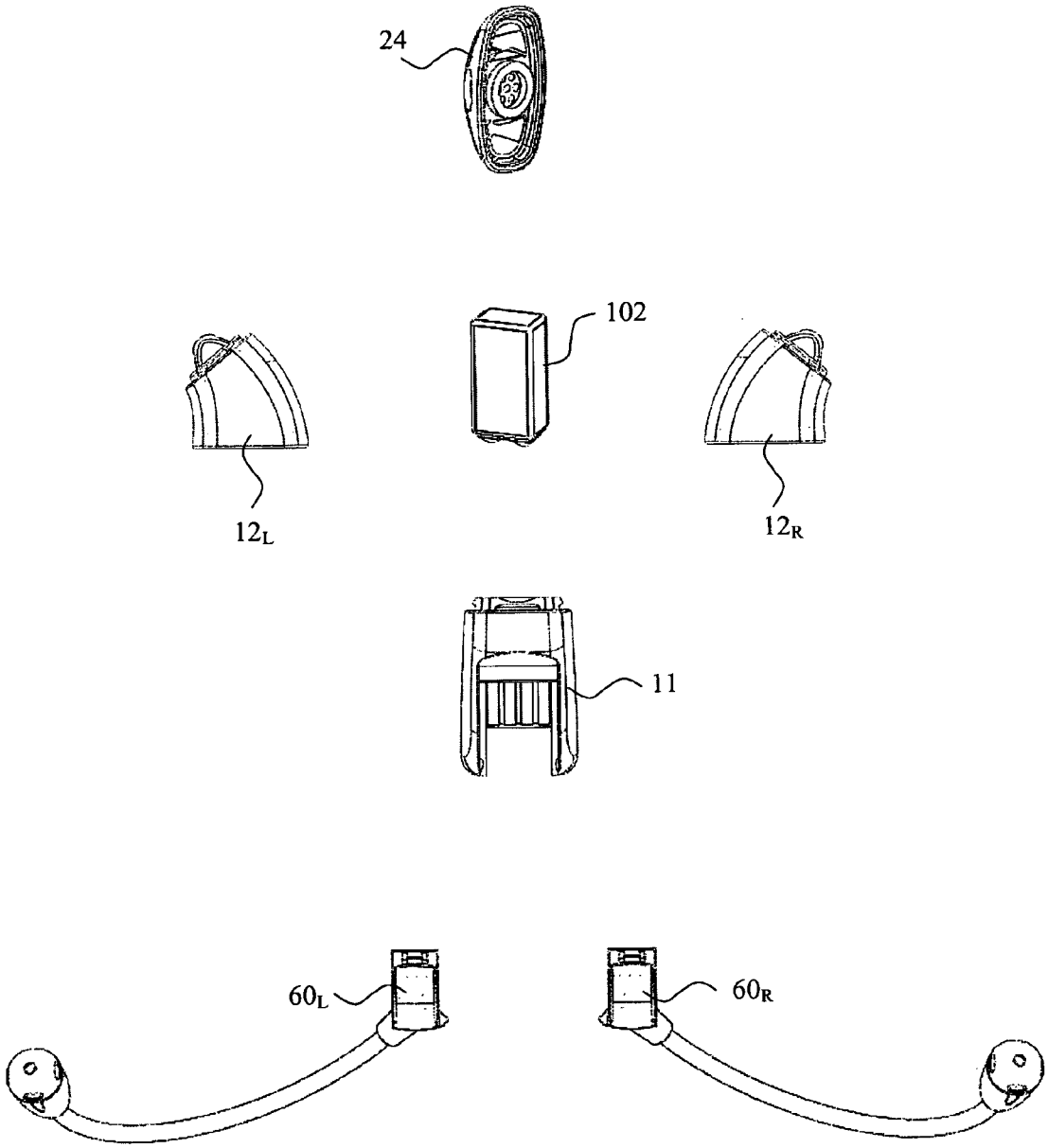
Figure 12:
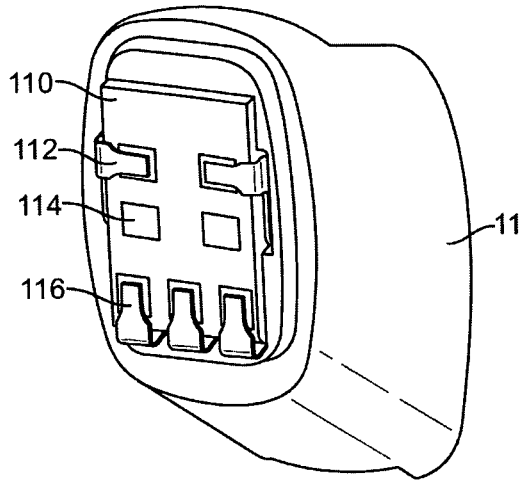
Figure 13:
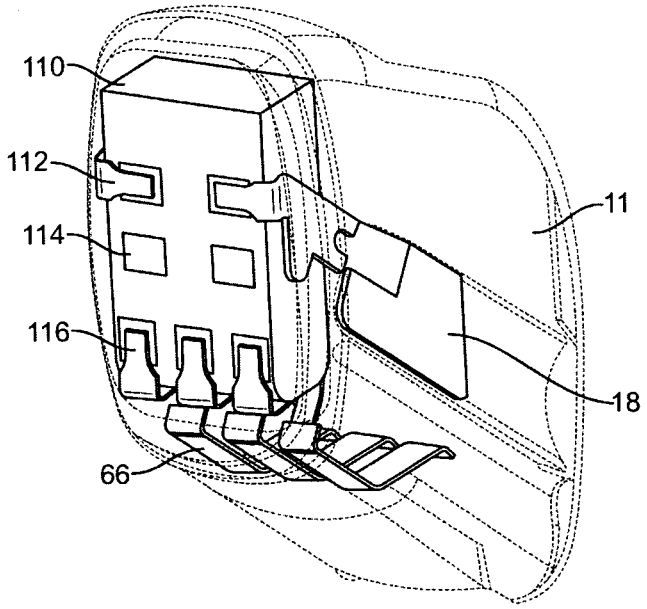
Figure 14:
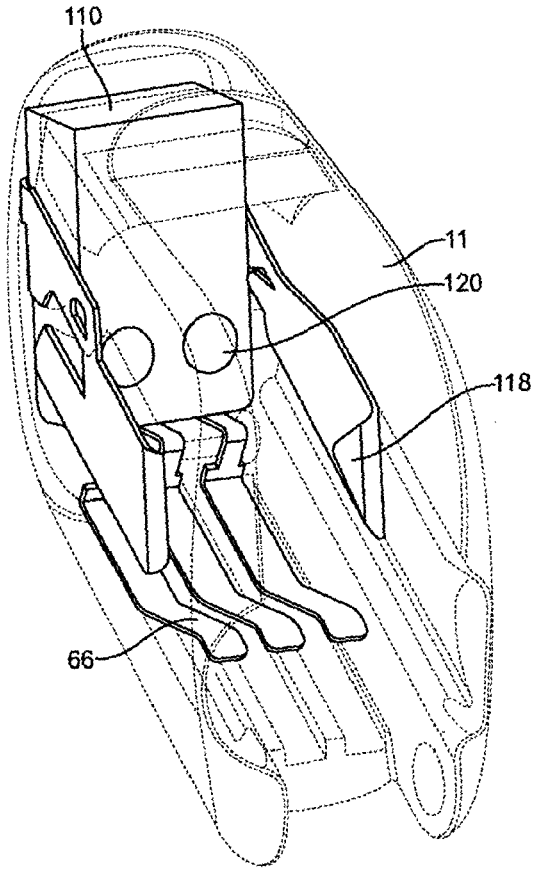
Figure 15:
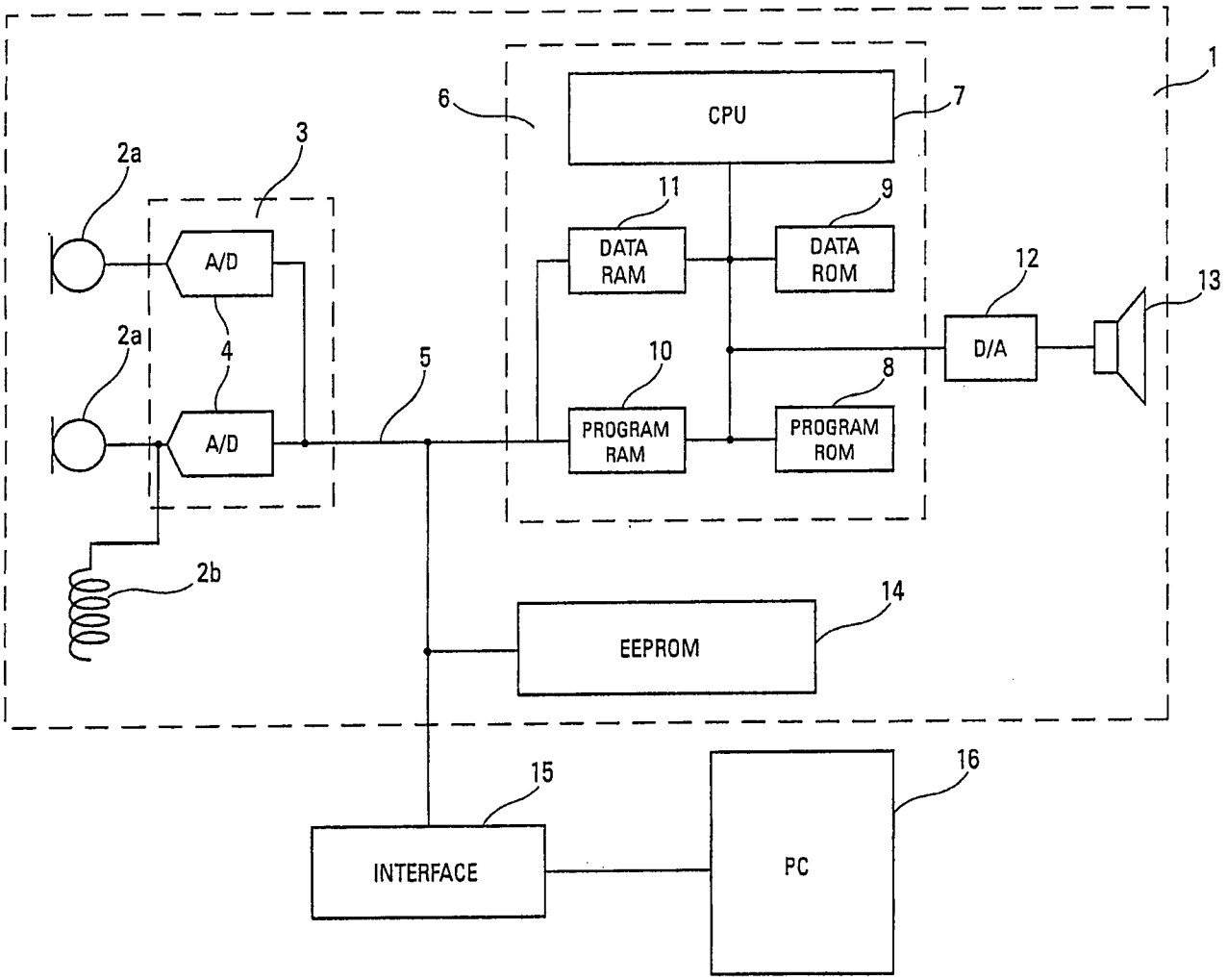
Figure 16:
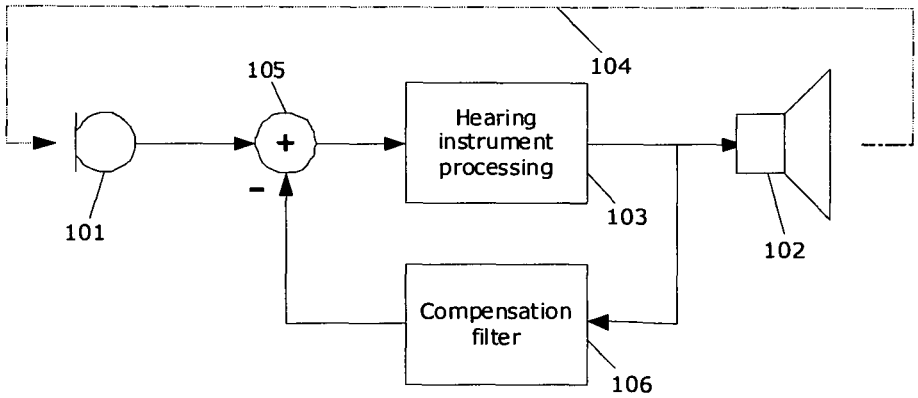

The above and other features and advantages will become more apparent to those of ordinary skill in the art by describing in detail exemplary embodiments thereof with reference to the attached drawings in which:

FIG. 1 is a perspective view of an embodiment of a hearing instrument configured for insertion into the right ear canal of a user, FIG. 2 shows the embodiment of FIG. 1 positioned in the right ear of a user, FIG. 3 shows an embodiment of the hearing instrument positioned in the left ear of a user, FIG. 4 shows a cross-section of the right ear canal of a user seen from above with a hearing instrument housing according to some embodiments inserted in the ear canal, FIG. 5 shows physical dimensions of two exemplified embodiments, FIG. 6 shows from above the embodiment of FIG. 1 with an open battery door, FIG. 7 shows the trunk part and the tip part of a hearing instrument housing of the embodiment of FIGS. 1 and 6, FIG. 8 shows the elongate member connected to a battery door of the embodiment of FIGS. 1 and 6, FIG. 9 illustrates positioning of a microphone at the second end of an elongate member, FIG. 10 shows a detail of an interconnection between an elongate member and a battery door, FIG. 11 shows a set of hearing instrument housing parts according to some embodiments, FIG. 12 shows the Signal Processor Module forming an end wall of the trunk part of the housing from the side facing the tip part, FIG. 13 corresponds to FIG. 12 with transparent walls of the trunk part of the housing, FIG. 14 shows the Signal Processor Module forming an end wall of the trunk part of the housing from the opposite side of FIGS. 12 and 13, FIG. 15 shows a simplified block diagram of a digital hearing aid enclosed in a housing according to some embodiments, and FIG. 16 shows a block diagram of a hearing aid with one feedback compensation filter.

DESCRIPTION OF THE EMBODIMENTS

The embodiments will now be described more fully hereinafter with reference to the accompanying drawings. The claimed invention may, however, be embodied in different forms and should not be construed as limited to the embodiments set forth herein. Thus, the illustrated embodiments are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. Like reference numerals refer to like elements throughout.

FIG. 1 shows in perspective a first embodiment of a hearing instrument, namely a hearing aid. FIG. 2 shows the embodiment of FIG. 1 positioned in the right ear of a user. The illustrated hearing aid has a housing 10 with a trunk part 11 and a right tip part 12 fitting into the right ear canal of the user. The right tip part 12 forms an angle towards the left in the medial direction with relation to the longitudinal extension of the trunk part 12 of the housing thereby comfortably fitting the right ear canal 220 for retention of the housing in the right ear of the user. The housing accommodates the hearing aid components, the tip part 12 of the housing 10 accommodating the receiver (not shown) for emission of sound through an output port (not shown) towards the eardrum of the user.

The illustrated trunk part 11 of the housing 10 is substantially straight along its longitudinal extension and has a substantially rectangular cross-section both perpendicular to and in parallel with its longitudinal extension seen from the side and seen from above.

The housing 10 further comprises an elongate member 14 that is attached to the trunk part 11 of the housing 10 and adapted for positioning within the pinna 200 during use. More specifically, the elongate member 14 is adapted to be positioned in the cimba concha 260 of the ear of the user. The elongate member 14 and the trunk part 11 of the housing 10 form separate units that are manufactured in separate pieces. The microphone of the hearing aid housing 10 is positioned at the microphone input port 16 at the second end 18 of the elongate member 14. The remaining parts of the housing 10 accommodate the other components. Signal conductors extend within the elongate member 14 for electrical interconnection of the microphone with the other components in the housing 10.

Positioning of the microphone(s) of the hearing aid at the second end 18 of the elongate member 14 provides an increased distance between the microphone(s) and the output port as compared to the corresponding distance in conventional ITE and CIC hearing aids whereby feedback is diminished.

In the illustrated embodiment, the trunk part 11 and elongate member 14 are manufactured as separate parts that are removably interconnected mechanically and electrically.

The illustrated trunk part 11 of the housing 10 and the elongate member 14 are manufactured in a number of respective standard sizes to fit the human anatomy of the ear of most users. In this way, the manufacturing cost is lowered as compared to the manufacturing cost of customized housings.

As illustrated in more detail in FIGS. 6-8, the elongate member 14 is removably interconnected with the trunk part 11 of the housing 10 so that a large number of different models of the hearing aid housing 10 may be provided by combining elongate members 14 of different standard sizes with trunk parts 11 of different standard sizes.

The elongate member 14 is adapted to be positioned in the concha of the pinna 200 of the user and has a longitudinal shape with a first end 20 attached to the trunk part 11 of the housing 10 and an opposite second end 18.

The elongate member 14 assists in retaining the housing 10 in the ear canal 220 of the user so that the housing 10 remains securely in place in the ear canal 220 without falling out of the ear. Retention is provided without causing pain to the user. Retention of the device in the proper place is important. Jaw movements during chewing for instance can exert outward forces on the housing 10 of the hearing aid. The elongate member 14 counteracts this force thereby sufficiently securing the housing 10 from outward motion.

The illustrated elongate member 14 is resilient in a direction perpendicular to the longitudinal extension thereby providing further retention capability of the housing 10 in the ear canal 220 of the user. During positioning of the housing 10 in its intended position in the ear canal 220 of the user, the transverse resilience of the elongate member 14 facilitates insertion of the housing 10 into the ear canal 220 of the user.

The elongate member 14 is adapted to abut the antihelix 230 and extend to the inferior crus 250 of the antihelix so that the second end 18 is positioned at the cimba concha 260 of the ear below the triangular fossa when the hearing aid housing 10 is positioned in the ear of the user.

The elongate member 14 has a larger cross-section at the second end 18 accommodating the microphone than a remaining part of the elongate member 14 extending therefrom and towards the first end 20.

The elongate member 14 may accommodate further electrical hearing aid components.

The illustrated elongate member 14 is substantially rigid in the direction of its longitudinal extension so that electrical conductors residing in the elongate member 14 are protected against breaking.

With a microphone in the elongate member 14 at its second end 18 that is positioned at the cimba concha 260 of the ear below the triangular fossa, localisation is substantially maintained since the microphone is positioned at a location within the pinna 200 wherein the received sound signal enables the user to perceive direction towards a sound source from the signal transmitted to the ear drum of the user by the hearing aid housing 10.

Two microphones may be accommodated at the second end 18 of the elongate member 14 for provision of noise suppression and/or further directionality.

The elongate member may further be adapted to abut part of the concha at the antitragus 280 when the housing 10 has been inserted in the ear canal 220 thereby applying a force to the housing 10 towards the ear canal retaining the housing 10 in a position in which the housing 10 is pressed against an anatomical feature within the ear canal.

The illustrated embodiment further comprises a cerumen filter 24 that is fitted on the tip part 12 of the housing 10. The cerumen filter 24 is coupled to the tip part 12 by means of a snap fit coupling.

FIG. 3 shows an embodiment of a hearing aid positioned in the left ear of a user. The illustrated hearing aid may have all of the features of the hearing aid shown in FIGS. 1 and 2.

FIG. 4 shows in horizontal cross-section the positioning of the hearing aid housing 10 of FIGS. 1 and 2 in the right ear canal 220 of a user. The cross-section of FIG. 4 is taken along line AB in FIG. 2. The viewing direction is from above as indicated by the arrow in FIG. 2. The tip part 12 of the housing 10 forms an angle towards the left in relation to the longitudinal extension of the trunk part 11 when seen from above and in the medial direction, i.e. from the entrance of the ear canal towards the ear drum. The bend towards the left facilitates accommodation of the housing 10 in the right ear canal 220 of the user.

Preferably, the tip part 12 is flexible for variation of the angle for accommodation of the housing 10 to varying angles of different users. Preferably, the housing 10 is flexible for comfortable accommodation of the housing 10 in the ear canal of the user providing a high level of comfort.

The illustrated housing 10 has a cross-section that is smaller than the cross-section of the ear canal 220 so that occlusion is reduced or eliminated. When the housing 10 is inserted into the user's ear canal 220, the smaller cross-section of the housing 10 allows communication between the ear canal between the eardrum and the housing 10 and the surroundings for prevention of occlusion. The illustrated hearing aid housing 10 is positioned completely in the ear canal of the user like a conventional CIC hearing aid. When the hearing aid housing 10 is properly inserted into the ear canal of the user, the outward pointing end of the hearing aid housing 10 with the battery door 60 is aligned with, or approximately aligned with, the cavum conchae 290, i.e. the battery door 60 coincides with, or approximately coincides with, the delimitation between the cavum conchae and the ear canal. Preferably, the battery door 60 resides slightly inside the delimitation between the cavum conchae and the ear canal so that the entire housing 10 is accommodated within the ear canal of the user.

FIG. 5 shows the physical dimensions of two exemplified embodiments.

FIG. 6 shows from above the embodiment of FIG. 1 with an open battery door 60. The battery door 60 is provided at the lateral end of the trunk part 11 of the housing 10 pointing out of the ear canal when the hearing aid housing 10 is positioned in the ear. The battery door 60 has a compartment 62 accommodating the hearing aid battery (not shown). The user may open or close the battery door 60 by rotating the battery door around an axis of rotation provided by a hinge connection 72. The battery compartment 62 swings out of the trunk part 11 of the housing 10 when the battery door 60 is opened whereby the battery may be exchanged with a new battery.

The elongate member 14 is attached to the battery door 60 and the battery door 60 is removably attached to the trunk part 11 of the housing 10 with a connector 64 including the hinge connection 72. In the illustrated embodiment, the hinge connection 72 has a shaft 74, and the battery door 60 has a flexible recess 76 so that a person may attach the battery door 60 to the trunk part 11 by pressing the recess 76 around the shaft 74 whereby the recess 76 expands slightly to accommodate the shaft 74 and snaps back for retention of the shaft within the recess. Likewise, the user may remove the battery door 60 from the trunk part 11 by pulling the battery door 60 away from the trunk part 11 whereby the recess expands to release the shaft and snaps back into its original relaxed shape upon release of the shaft 74. The illustrated snap fit coupling for interconnection of the battery door 60 with the trunk part 11 is designed so that the force required to separate the battery door 60 from the trunk part 11 is larger than the force required to pull the hearing aid housing 10 out of the ear canal of the user by pulling the elongate member 14.

The illustrated hearing aid housing connector 64 further comprises resilient electrical contact members 66 for electrical interconnection of signal conductors in the elongate member 14 with electrical components in the housing 10. The illustrated embodiment has three contact members 66, however other embodiments may have more than three contact members.

FIG. 7 shows the hearing aid housing 10 with the battery door 60 removed, and FIG. 8 shows the removed battery door 60 with the elongate member 14.

It is an important advantage of the illustrated embodiment that electrical contact members 68 of the interconnected battery door 60 and elongate member 14 mating the contact members 66 of the hearing aid housing connector 64 connect slidably with respective electrical contact members 66 of the trunk part 11 when the battery compartment 62 is closed by rotation. The sliding connection provides a cleaning action thereby cleaning the contact surfaces maintaining a low contact resistance across the electrical interconnection of the hearing aid components, e.g. by mechanical removal of oxide film formed on the contact surfaces, or mechanical removal of other undesired deposits on the contact surfaces.

In another embodiment, the elongate member 14 is removably connected directly with the trunk part 11 of the hearing aid housing 10. In this embodiment (not shown), the elongate member 14 has an electrical connector at its second end mating a corresponding hearing aid housing connector. The elongate member 14 with the connector is inserted through a hole provided in the hearing aid housing 10. The battery door 60 may be provided with a suitable mechanical member that assists in attaching the elongate member 14 to the trunk part 11 of the hearing aid housing 10 by abutment with the elongate member 14 when the battery door 60 is closed. The battery door may include locking means preventing the battery door from being inadvertently opened e.g. due to forces applied to the elongate member 14.

FIGS. 9 (*a*)-(*c*) illustrate positioning of a microphone 2*a* at the second end 18 of an elongate member 14 in accordance with some embodiments. As shown in FIG. 9 (*a*), the microphone 2*a* and its signal conductors 17 are inserted into the elongate member 14 through an open second end 18 of the elongate member 14, and the microphone 2*a* is pushed into its desired position shown in FIG. 9 (*b*). The signal conductors 17 with the signal line of the microphone 2*a* extend inside the elongate member 14. Finally, a threaded cap 19 with a dirt filter closes the opening of the elongate member 14 as illustrated in FIG. 9 (*c*). The dirt filter at this position protects the microphone against sweat, dirt, dead cells, etc., from the pinna. A cerumen filter may be used as the dirt filter.

FIG. 10 illustrates the interconnection of the signal conductors 17 with the contact members 68 in accordance with some embodiments. In the illustrated embodiment, three contact members 68 are shown, however, more than three contact members may be available in other embodiments. In the illustrated embodiment, the contact members 68 are provided on a slide member that may slide into a mating compartment in the battery door for positioning of the contact members 68 as for example illustrated in FIG. 8. Upon insertion of the microphone 2*a* and the signal conductors 17 into the elongate member 14, the exposed ends of the signal conductors 17 are soldered onto the contact members 68 provided on the slide member. Subsequently, the slide member is inserted into the battery door 60 and possibly glued to the battery door.

FIG. 11 shows a set of hearing aid housing parts according to some embodiments. The set comprises a trunk part 11 configured for interconnection with a tip part $\mathbf{12}_R$, $\mathbf{12}_L$ and that is substantially straight along its longitudinal extension. Further, the set comprises a right tip part $\mathbf{12}_R$ that forms an angle facilitating accommodation in the right ear canal of the user, and a left tip part $\mathbf{12}_L$ that forms an angle facilitating accommodation in the left ear canal of the user of a hearing aid housing 10. A straight tip part (not shown) that is straight and extends along the longitudinal extension of the trunk part when interconnected with the trunk part may also be provided.

The illustrated set of hearing aid housing parts further comprises a receiver 102 and a cerumen filter 24, and a left ear battery door $\mathbf{60}_L$ to be removably attached to the trunk part 11 of the housing 10 and attached to the elongate member 14 at an angle suitable for use in the left ear, and a right ear battery door $\mathbf{60}_R$ removably attached to the trunk part 11 of the housing 10 and attached to the elongate member 14 at an angle suitable for use in the right ear.

Each of the parts illustrated in FIG. 11 may be manufactured in a variety of standard sizes and shapes whereby a large variety of housings may be provided based on combinations of a relatively few number of standard sized and shaped parts. In this way, the dispenser will be able to offer users a large variety of housings in an economical way that does not require purchase and storage of a large number of different housings.

FIGS. 12 and 13 show the Signal Processor Module 110 forming an end wall of the trunk part 11 of the housing 10. The Signal Processor Module 110 holds the signal processor (not shown) and has a number of connector pads for interconnection with other electrical components of the hearing aid. The springs 118 are soldered to the two connector pads 112 for interconnection of the Signal Processor Module 110 with the battery. When the battery door with the battery in the battery compartment is closed, the battery swings in between the springs 118 that are pressed against the respective flat surfaces of the battery and thereby interconnect the plus and minus terminals of the battery with the Signal Processor Module 110. In the event, the housing 10 accommodates a rechargeable battery, the springs 118 may be extended to the outer surface of the housing 10 for provision of readily accessible contacts for recharging of the rechargeable battery. The receiver is soldered onto the two connector pads 114. In another embodiment, the Signal Processor Module has a connector mechanically mating with the receiver for interconnection of the receiver with the Signal Processor Module without soldering. The three springs 66 are soldered onto the respective connector pads 116 and interconnect the Signal Processor Module 110 with the signal lines in the elongate member as previously explained in connection with FIG. 7. The springs 66, 118 may provide a snap fit coupling of the Signal Processor Module 110 by provision of protrusions. During mounting of the Signal Processor Module 110, the module 110 is pressed passed the resilient protrusions of the springs 66, 118 that allow passage of the board and spring back after full insertion of the Signal Processor Module into the trunk part 11 of the housing 10 thereby holding the Signal Processor Module 110 in a fixed position in the trunk part 11.

With the receiver accommodated in the tip part of the housing 10, the Signal Processor Module acts as a sound barrier for increased internal stability of the hearing aid circuitry.

By accommodation of the Signal Processor Module as a wall in the hearing aid housing 10 a minimum of space is occupied by the Signal Processor Module in the housing 10 whereby the size of the housing 10 is minimized.

It should be noted that provision of springs for mechanical and electrical interconnection with the battery and the microphone(s) has eliminated wiring in the hearing aid whereby handling and assembly of the hearing aid has been significantly simplified leading to reduced manufacturing cost.

Further, the receiver may be installed in the hearing aid housing 10 by the dispenser so that the dispenser may be able to offer a variety of models to the user without a need for purchasing and storing a similar variety of hearing aids.

FIG. 14 shows the Signal Processor Module 110 forming an end wall of the trunk part 11 of the housing 10 from the opposite side of FIGS. 12 and 13. From this side, the connector pads 120 for the programming of the hearing instrument are accessible. During programming of the hearing instrument, e.g. adjustment of signal processing parameters of the hearing instrument, a programming connector (not shown) of the programming equipment for the hearing device is inserted in the battery compartment of the illustrated housing 10 for electrical interconnection with the connector pads 120. The programming connector may mechanically engage with the springs 118 for keeping the programming connector in a fixed position during programming. Alternatively, the battery door may be closed for retaining the programming connector (not shown) in the battery compartment. As an alternative, any selected set of contacts from the group consisting of the springs 118 and the contact members 66 may be used for programming of the hearing instrument.

FIG. 15 shows a simplified block diagram of a digital hearing aid according to some embodiments. The hearing aid 401 comprises one or more sound receivers 402, e.g. two microphones 402*a* and a telecoil 402*b*. The analogue signals for the microphones are coupled to an analogue-digital converter circuit 403, which contains an analogue-digital converter 404 for each of the microphones.

The digital signal outputs from the analogue-digital converters 404 are coupled to a common data line 405, which leads the signals to a digital signal processor (DSP) 406. The DSP is programmed to perform the necessary signal processing operations of digital signals to compensate hearing loss in accordance with the needs of the user. The DSP is further programmed for automatic adjustment of signal processing parameters in accordance with some embodiments.

The output signal is then fed to a digital-analogue converter 412, from which analogue output signals are fed to a sound transducer 413, such as a miniature loudspeaker.

In addition, externally in relation to the DSP 406, the hearing aid contains a storage unit 414, which in the example shown is an EEPROM (electronically erasable programmable read-only memory). This external memory 414, which is connected to a common serial data bus 405, can be provided via an interface 415 with programmes, data, parameters etc. entered from a PC 416, for example, when a new hearing aid is allotted to a specific user, where the hearing aid is adjusted for precisely this user, or when a user has his hearing aid updated and/or re-adjusted to the user's actual hearing loss, e.g. by an audiologist.

The DSP 406 contains a central processor (CPU) 407 and a number of internal storage units 408-411, these storage units containing data and programmes, which are presently being executed in the DSP circuit 406. The DSP 406 contains a programme-ROM (read-only memory) 408, a data-ROM 409, a programme-RAM (random access memory) 410 and a data-RAM 411. The two first-mentioned contain programmes and data which constitute permanent elements in the circuit, while the two last-mentioned contain programmes and data which can be changed or overwritten.

The housing 10 of the illustrated hearing aid accommodates the above-mentioned hearing aid components except the microphone in a way similar to the housing 10 of a CIC hearing aid. The elongate member accommodates the microphone, e.g. at its second end, and signal conductors extend within the elongate member for electrical interconnection of the microphone with the components in the hearing aid housing 10. The receiver is accommodated in the tip part of the housing 10.

Typically, the external EEPROM 414 is considerably larger, e.g. 4-8 times larger, than the internal RAM, which means that certain data and programmes can be stored in the EEPROM so that they can be read into the internal RAMs for execution as required. Later, these special data and programmes may be overwritten by the normal operational data and working programmes. The external EEPROM can thus contain a series of programmes, which are used only in special cases, such as e.g. start-up programmes.

A block diagram of an embodiment of a hearing aid with a feedback compensation filter 106 is shown in FIG. 16. The hearing aid comprises a microphone 101 for receiving incoming sound and converting it into an audio signal. A receiver 102 converts output from the hearing aid processor 103 into output sound, which in, e.g., a hearing aid is supposed to be modified to compensate for a users hearing impairment. Thus, the hearing aid processor 103 comprises elements such as amplifiers, compressors and noise reduction systems etc.

A feedback path 104 is shown as a dashed line between the receiver 102 and the microphone 101. Due to the feedback path, the microphone 101 may pick up sound from the receiver 102 which may lead to well known feedback problems, such as whistling.

The (frequency dependent) gain response (or transfer function) H(ω) of the hearing aid (without feedback compensation) is given by:

$$H(\omega) = \frac{A(\omega)}{1 - F(\omega)A(\omega)} \tag{1}$$

where ω represents (angular) frequency, F(ω) is the gain function of the feedback path 104 and A(ω) is the gain function provided by the hearing aid processor 103. The feedback compensation filter 106 is adapted to feed a compensation signal to the subtraction unit 105, whereby the compensation signal is subtracted from the audio signal provided by the microphone 101 prior to processing in the hearing aid processor 103. The transfer function now becomes:

$$H(\omega) = \frac{A(\omega)}{1 - (F(\omega) - F'(\omega))A(\omega)} \tag{2}$$

where F'(ω) is the gain function of the compensation filter 106. Thus, F'(ω) estimates the true gain function F(ω) of the feedback path, the closer H(ω) will be to the desired gain function A(ω).

As previously explained, the feedback path 104 is usually a combination of internal and external feedback paths and acoustical and mechanical feedback paths.

The invention claimed is:

1. A hearing instrument, comprising:

a housing;

a printed circuit board;

a signal processor on the printed circuit board, wherein the signal processor is configured for generating an audio signal; and a receiver that is connected to an output of the signal processor for converting the audio signal into a sound signal;

wherein the housing is configured to accommodate the receiver and the printed circuit board with the signal processor, and the housing has a trunk part that is coupled with a tip part; and wherein the printed circuit board extends transversely relative to a longitudinal extension of the trunk part; and wherein the printed circuit board forms a wall partitioning a space in the housing into a first space and a second space.

2. The hearing instrument according to claim 1, wherein the housing is configured for placement in an ear canal, and wherein the housing does not obstruct the ear canal when positioned in its intended operational position in the ear canal.

3. The hearing instrument according to claim 1, wherein the receiver is accommodated in the tip part of the housing.

4. The hearing instrument according to claim 3, wherein the wall formed by the printed circuit board is in the trunk part of the housing.

5. The hearing instrument according to claim 1, wherein the printed circuit board further comprises connector pads for connection with programming equipment for the hearing instrument.

6. The hearing instrument according to claim 1, wherein the trunk part of the housing further comprises a connector for making mechanical and electrical contact with the receiver.

7. The hearing instrument according to claim 1, wherein the wall formed by the printed circuit board comprises connector pads for connection with a battery.

8. The hearing instrument according to claim 7, further comprising first springs coupled with the connector pads for connection of the printed circuit board with the battery.

9. The hearing instrument according to claim 8, wherein the first springs provide a mechanical snap fit coupling of the printed circuit board to the housing.

10. The hearing instrument according to claim 7, further comprising:

an elongate member attached to the housing; and springs connected with signal lines in the elongate member;

wherein the elongate member is configured for placement in a pinna and outside an ear canal of a user for retention of the housing in the ear canal.

11. The hearing instrument according to claim 10, wherein the springs provide a mechanical snap fit coupling of the printed circuit board to the housing.

12. The hearing instrument according to claim 1, further comprising a protective material covering at least a part of the printed circuit board, wherein the protective material is accommodated in the housing.

13. The hearing instrument according to claim 1, wherein the tip part is custom made to fit an ear canal, and the trunk part is manufactured in a standard size.

14. The hearing instrument according to claim 1, wherein the tip part and the trunk part are manufactured in respective standard sizes.

15. The hearing instrument according to claim 14, wherein the housing further comprises a custom made part fitting around the standard-sized tip part for fitting the housing to an ear canal.

16. The hearing instrument according to claim 14, wherein the housing further comprises a flexible part fitting around the standard-sized tip part for fitting the housing to an ear canal.

17. The hearing instrument according to claim 16, wherein the flexible part is manufactured in a standard size.

18. The hearing instrument according to claim 1, wherein the tip part of the housing is flexible.

19. The hearing instrument according to claim 1, further comprising a cerumen filter that is configured to be fitted on the tip part of the housing with a snap on coupling.

20. The hearing instrument according to claim 1, further comprising an elongate member that is removably attached to the housing, the elongate member configured for placement in a pinna and outside an ear canal of a user for retention of the housing in the ear canal.

21. The hearing instrument according to claim 20, wherein the elongate member is manufactured in a standard size.

22. The hearing instrument according to claim 20, wherein the elongate member has a longitudinal shape with a first end attached to the housing and an opposite second end.

23. The hearing instrument according to claim 1, further comprising an elongate member, wherein the housing comprises a battery door removably attached to the trunk part of the housing, and wherein the elongate member is attached to the battery door.

24. A hearing instrument, comprising:

a housing;

a printed circuit board;

a signal processor on the printed circuit board, wherein the signal processor is configured for generating an audio signal; and a receiver that is connected to an output of the signal processor for converting the audio signal into a sound signal;

wherein the housing is configured to accommodate the receiver and the printed circuit board with the signal processor, and the housing has a trunk part that is coupled with a tip part; and wherein the printed circuit board forms a wall that extends transversely relative to a longitudinal extension of the trunk part, the wall partitioning a space in the housing into a first space and a second space;

wherein the housing comprises a battery door removably attached to the trunk part of the housing, and wherein the elongate member is attached to the battery door; and wherein the housing further comprises a connector for making electrical contact with a signal line in the elongate member when the battery door is attached to the trunk part of the housing.

25. The hearing instrument according to claim 1, further comprising a tinnitus relieving circuit within the housing.

26. The hearing instrument according to claim 1, further comprising a noise cancelling circuit within the housing.

27. The hearing instrument according to claim 1, wherein the wall comprises an end wall of the trunk part of the housing.

28. The hearing instrument according to claim 1, wherein the printed circuit board is next to an end wall portion of the housing in a side-by-side configuration.

29. The hearing instrument according to claim 28, wherein in the side-by-side configuration, a plane of the printed circuit board corresponds with a plane of the end wall portion.

30. The hearing instrument according to claim 12, wherein the printed circuit board is casted in the protective material.

31. The hearing instrument according to claim 1, wherein the first space accommodates a first circuit component, the second space accommodates a second circuit component, and the wall formed by the printed circuit board is between the first circuit component and the second circuit component.

* * * * *